US006196279B1

(12) United States Patent
Baker

(10) Patent No.: US 6,196,279 B1
(45) Date of Patent: Mar. 6, 2001

(54) ASPHALT LOADING SAFETY SYSTEM CONTROL CIRCUIT

(75) Inventor: Richard L. Baker, Columbia, MO (US)

(73) Assignee: Ashland Chemical Company, Columbus, OH (US)

( * ) Notice: Subject to any disclaimer, the term of this patent is extended or adjusted under 35 U.S.C. 154(b) by 0 days.

(21) Appl. No.: 09/411,861

(22) Filed: Oct. 4, 1999

Related U.S. Application Data

(63) Continuation-in-part of application No. 08/928,521, filed on Sep. 12, 1997, now Pat. No. 6,006,796.

(51) Int. Cl.[7] ..... B65B 1/04

(52) U.S. Cl. ..... 141/98; 141/1; 141/94; 141/351; 222/23; 222/181.2

(58) Field of Search ..... 141/1, 94, 95, 141/387, 351, 98, 83; 222/23, 181.2

(56) References Cited

U.S. PATENT DOCUMENTS 3,119,523 * 1/1964 Jaffe .
4,402,350 * 9/1983 Ehret et al. ..... 141/94
4,629,392 * 12/1986 Campbell et al. ..... 414/786
5,427,161 * 6/1995 Luhmann et al. ..... 141/144
5,881,780 * 3/1999 Matye et al. ..... 141/232

* cited by examiner

*Primary Examiner*—Steven O. Douglas
(74) *Attorney, Agent, or Firm*—Frank J. Kowalski; Martin Connaughton; Vernon F. Venne

(57) ABSTRACT

An electric circuit for a system to prevent accidental discharge of hot-mix asphalt at asphalt plants with multiple silos includes a manual switch which energizes a relay holding the circuit closed. A time delay relay is also energized to provide a time period to determine whether the process should continue. When the time delay times out, a solenoid is energized to open a hot mix storage silo. A closed circuit TV camera and a system of flashing lights are included to provide a fixed view of the loading area with a monitor at the control panel. When hot-mix asphalt is to be discharged into a truck, a switch is activated which causes a light beneath the bin to flash. This identifies the bin selected to open. The TV monitor is viewed and the position of the truck can now be visually confirmed along with the flashing light on the bin that has been activated. The manual switch must be pushed in order to complete the discharge of the hot-mix asphalt from the bin. Ideally, the manual switch is located either on the monitor or as close to it as possible in order to force the viewing of the screen before activating the manual switch to provide visual confirmation during the time delay.

8 Claims, 4 Drawing Sheets

ASPHALT LOADING SAFETY SYSTEM CONTROL CIRCUIT

RELATED APPLICATIONS

The present application is a continuation in part of patent application Ser. No. 08/928,521, now U.S. Pat. No. 6,006,796, filed Sep. 12, 1997 titled "Asphalt Loading Safety System".

BACKGROUND OF THE INVENTION

1. Field of the Invention

The present invention pertains to safety systems and more particularly to electric control circuits for safety systems used in conjunction with loading materials that may be hazardous to personnel when handled directly such as hot asphalt.

2. Related Prior Art

In modern road construction, asphalt is a material of choice due to its ability to provide a smooth surface for travel while providing a surface rough enough for tire gripping ability for stopping. Its relative cost effectiveness, durability and ease to work with provide added benefits that increase its desirability.

Asphalt, in a strict sense, is obtained as a residue from certain petroleums and primarily consists of a mixture of hydrocarbons and varies from hard and brittle to plastic forms. It is insoluble in water but soluble in gasoline. It melts on heating and burns with a smokey flame. Asphalt may be widely used for paving, roofing, paints and varnishes. Light renders certain grades of asphalt insoluble in oil of turpentine, and hence, they are used in photomechanical work. Most native or naturally occurring asphalt is a residue in the form of evaporated petroleum. For the purposes of this patent, however, the term asphalt will be used in conjunction with the type of asphalt referred to in road construction that is used for pavements.

In present day society as more and more of our road systems, including interstate super highways, are being made of asphalt, the demand for asphalt increases along with its manufacture and concomitant transportation from the location of preparation to the location of ultimate use. The term asphalt when used to describe a road, such as an asphalt road, is generally referred to as hot mix asphalt (HMA) pavement in the industry. Hot mix asphalt is a combination of aggregates and asphalt cement.

Asphalt cement is the black, sticky substance that is produced by petroleum refineries. This substance is the residue remaining after all the more valuable fractions of a barrel of oil have been removed, fractions such as gasoline, fuel oil, diesel fuel, aviation fuel and others. This sticky substance is the glue that holds pavements together. In general, this glue is only about eight percent, by weight, of the pavement.

Aggregates account for about ninety-two percent, by weight, of the mixture that goes into the pavement. The aggregates are usually various sized stones, dust and sand. Basically, the aggregates are any hard, inert mineral materials used for mixing in granulated fragments (crushed stone).

An asphalt plant is no more than a mixing facility that mixes hot asphalt cement and hot aggregates into hot mix asphalt. At an asphalt plant, paving aggregates are dried and heated, then mixed and coated with asphalt cement. This hot mixture is then placed in storage silos for short term storage.

There are two basic types of asphalt plants or HMA facilities, a drum mix facility and a batch mix facility. In a drum mix facility aggregates are stored in cold feed hoppers. The aggregates are measured into specific portions according to the kind of pavement required and carried by conveyor or a conveyor belt to a drum where they are dried and heated by a large burner. In this process pavement may be recycled and may be added to the center of the drum. Asphalt cement is stored in a holding tank where it is heated to between 275° F. and 300° F. The heated asphalt cement is pumped into the drum in liquid form where it mixes with and coats the aggregates. The drum operates like a clothes dryer. As it rotates, flights along its sides keep the aggregates tumbling and dropping which guarantees that they are thoroughly dried, heated and coated with asphalt cement. The coated aggregates are then carried by conveyor to the top of the storage silos.

A batch mix facility differs from a drum facility only in terms of where the asphalt cement coating takes place. In a batch mix facility, the aggregates are dried in the drum, but are then conveyed to a mixing tower where the dried aggregates are separated by a vibrating screen and dropped into individual storage bins by size. The separated aggregates are dropped from the holding bins to a weigh hopper, the amount of each size being determined by the type of mix being produced. From the weigh hopper the aggregates are transferred to a pugmill where they are coated with the asphalt cement which has been weighed separately. The finished product is traditionally transferred to a waiting truck, although it is becoming more common to transfer the mix to storage silos as is done in the drum facility.

Large quantities of asphalt are loaded into huge silos which can contain several tons of hot asphalt. In general, several of these silos are set up in line to hold a large batch of asphalt. Due to the massive quantities of asphalt needed for installing a road, many silos will exist in a single row. In general, the silos are spaced close together to reduce heat loss. The silos are all elevated a significant distance above the ground in order that a truck to be able to pull underneath them. Once a truck is pulled underneath the proper silo, a hatch is opened and the hot asphalt is loaded into the back of the dump truck. The dump truck then proceeds to transport the hot asphalt to the location where the road is being installed. The hot asphalt is unloaded from the dump truck into a spreader which will deposit asphalt across a single lane of a highway at a uniform depth. The hot asphalt is then anchored in place or compressed through the use of a steam roller. Once the asphalt is cooled it becomes a hard surface upon which automobiles and trucks may travel smoothly.

When the asphalt is being loaded from the silo into the dump truck, the dump truck pulls up with its bed directly below the hatch for the silo. Once the truck is in position, the hatch opens and several tons of hot asphalt come streaming into the bed of the truck. In general, the driver will remain seated in the truck during the loading operation to reduce the total loading time. It is essential that the asphalt be transported to the location at which the road is being built in a short period of time. Although the asphalt will remain hot for several hours, it must be place in the spreader and rolled before it cools in order to provide a strong, hard surface upon which traffic may travel. Cool or cold asphalt does not bind together very well and will deteriorate and result in potholes in the smooth surface. As a result, asphalt truckloads that arrive with the load having a temperature below the minimum acceptable are sent back for reheating or recycling.

As a result, a dump truck arrives at the plant, quickly pulls under the silos, is loaded with asphalt and the truck departs. During the loading process, the driver stops only to place or confirm the order, to have the truck loaded and to have paperwork processed. The entire loading process is done as quickly as possible to have the asphalt arrive at the work site within preparation temperature limits.

In order to reduce heat loss while the asphalt is sitting in the silo, the silos are generally constructed to have a greater height than surface width. Since heat rises, a smaller surface area will allow less heat to escape. Accordingly, the silos are placed close together so that minimal heat is lost through the sides. This results in the silos being spaced apart approximately one half dump truck length. This means that while a dump truck is positioned such that the center of its bed is underneath one silo hatch, the cab of the truck will be located approximately beneath the hatch of another silo.

This situation provides a limited, but very real, degree of danger to the truck driver. Although millions of dump trucks have been loaded with hot asphalt since the beginning of its use for roads, the occurrence of injury to human workers has been minimal. However, on very rare occasions, through some type of inexperience or some type of miscommunication or a combination of both, injury has resulted to truck drivers. For example, the unloading of several tons of hot asphalt on the cab of a truck can result in severe burns to the driver. Even though the occurrence of such injury is extremely rare, if it could be prevented, such steps should be taken.

While attempts may be made to clearly indicate which silo is to be opened, there is always the probability that a new driver unfamiliar with the loading system may be present. A light may be present to indicate the silo to be unloaded, however unfamiliarity may cause a question as to whether the light indicates where the front of the truck should be located or where the bed of the truck should be located or where the cab of the truck should stop. If the truck is positioned incorrectly, hot asphalt can be dumped on a portion of the truck which may endanger the driver.

SUMMARY OF THE INVENTION

The present invention provides a safety system that greatly reduces the probability of a asphalt loading mishap which can endanger human life. Although asphalt has been used in paving roads for many years, modern technology has made the loading of hot asphalt simple and quick. In doing so, new [dangers] methods have been presented that can be dangerous.

The asphalt loading safety system for use with a plurality of asphalt silos provided by the present invention includes a visual display for identifying which of the asphalt storage silos is to be unloaded, a camera for providing a view of the silos and their associated lights, a switch associated with the visual display for initiating unloading of one of the silos and a security device for controlling unloading of the identified silo.

In a first embodiment, the security device includes a second switch to open a hatch corresponding to the identified silo.

In a second embodiment, the security device includes a delay device connected to the switch for postponing the opening of a hatch corresponding to the identified silo and a second switch operating in conjunction with the loading process for aborting the entire loading operation.

DESCRIPTION OF THE PREFERRED EMBODIMENT

Figure 1:
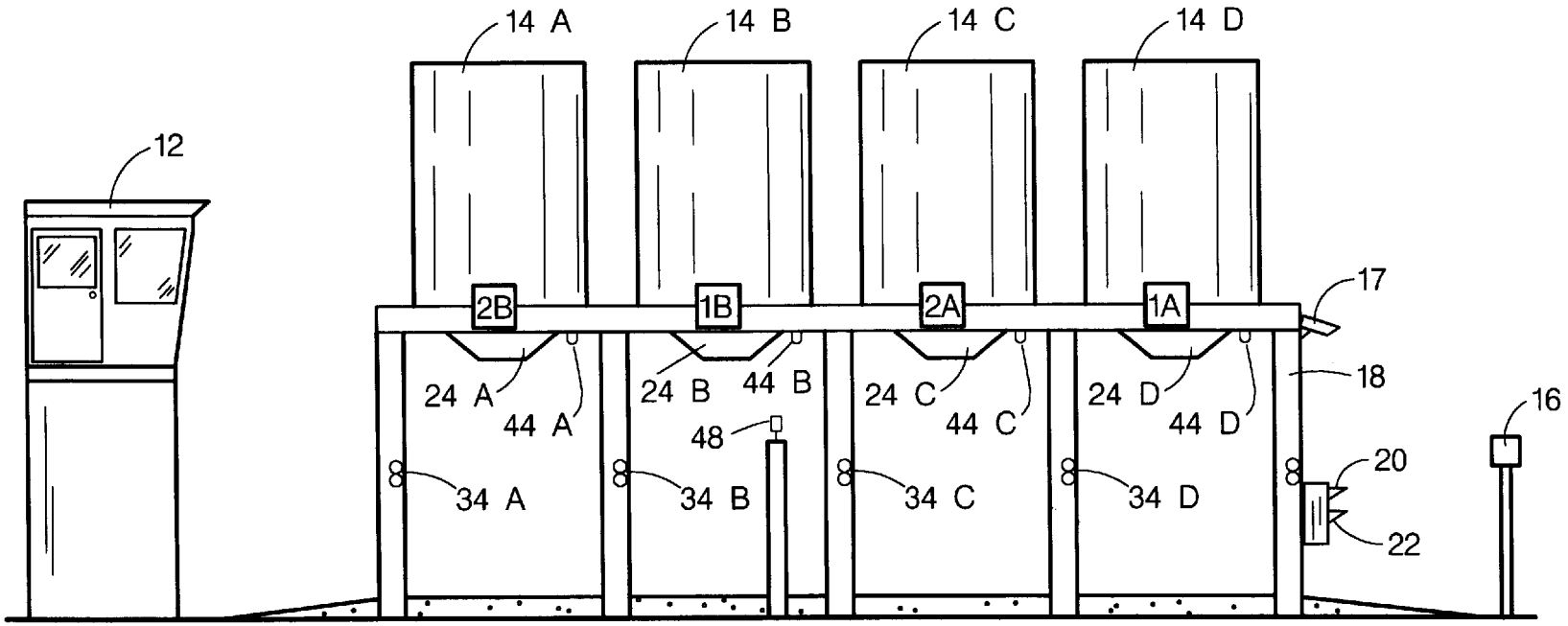
FIG. 1 is a side view of an asphalt loading area having a plurality of silos at an asphalt processing plant.

In present day asphalt processing plants, asphalt is processed, loaded and transported in large quantities. In general, the asphalt is placed in large silos, usually set in a row, for loading into large dump trucks. Several silos, each having the capability of filling up to fifteen standard size dump trucks, are placed over a driveway. The silos are placed next to each other in order to reduce heat loss since the asphalt must be set in place while it is still hot. Under normal conditions a truck will pull in place under specified silo and be loaded. This procedure reduces the amount of time required between loading the silo and shipping the asphalt. In practice, the truck driver will park his truck correctly positioned beneath an identified silo. A hatch is opened and one truck load of asphalt is emptied from the silo into the bed of the truck.

Unfortunately, accidents have occurred where, through miscommunication between the driver and the control operator, the truck driver would park beneath the wrong silo. If the truck is parked at a wrong silo in front of the proper silo the only damage that results is a load of asphalt dumping on the driveway. However, if the driver parks his truck at the silo behind the designated silo, a truck load of hot asphalt can be dumped on the cab of the truck, damaging the truck and possibly injuring the driver. The present invention provides a method and apparatus for avoiding the occurrence of this problem.

In practicing the present invention, the following scenario normally takes place. The truck driver pulls up to scales and pushes a red button that is on a speaker mounted approximately six foot high on a four by four post. This activates a camera mounted on the silo on the entrance side and turns on a speaker that is built into the camera monitor located in the control house. The monitor is easily accessible to the operator. Operator and driver communicate through the speakers to place order for mix. The operator then enters all pertinent information into the load out system (truck number, job number, item number, silo number, type of mix, etc.).

Once the information is entered the first traffic light turns green telling driver to enter scales. Each silo has a strobe light mounted underneath the silo tank. The strobe light mounted under the silo is illuminated to instruct the driver to position his truck under that silo. A camera, preferably one camera for each set of three silos, is mounted on the pipe rack to the silos, or some other location to the side of the silos, to provide the operator a side view of the truck under the silos. The operator is able to monitor the complete loading of the truck.

Once a truck is in place and the operator presses enter on the computer to start loading, a light is illuminated on the silo button box. The silo button box has a light corresponding to a switch for each silo. This provides an indication to the operator which silo was selected.

If an improper silo was selected or the truck is parked under the wrong silo, an emergency stop button can be pushed and the proper silo can then be selected or the driver can be instructed to move to the correct silo. This procedure gives the operator another opportunity to correct an error before loading starts.

If proper silo was selected the operator pushes the assigned silo loading button that is also mounted on the silo button box. The set of loading buttons on the silo button box includes one loading button for each silo. Only the button for the silo selected originally by the information entered in the computer will allow a silo to discharge. Each silo has its own strobe light mounted outside on the silo leg. This strobe light is illuminated when the loading button is pushed and remains in such condition for five seconds before silo gate is energized. This provides ample time for the operator to consider what he or she has done and to make any adjustments to the loading process before the silo gate engages. The strobe light is visible by both the driver and operator.

When loading starts, both traffic lights turn red to instruct truck being loaded to stay still and any other truck to be loaded not to enter the scales. Once loading of truck is complete, an audible alarm sounds and the second traffic light turns green instructing the loaded truck to exit the scales and to retrieve its ticket.

The truck pulls off of scales and retrieves ticket from chute mounted on control house. The chute is a six inch by six inch square passage made of steel tubing. A table is built on the chute for driver to sign the ticket. Copies are retrieved by a clothes pin tied to a string. Although this method of retrieval seems crude, it provides a simplistic, maintenance free way for tickets to be distributed to the driver. Alternatives, such as blow tubes, are expensive and material within them can get stuck. In other alternatives, tickets can get wet after a rain, or have a short shelf life.

The system of the present invention was designed to prevent accidental discharge of hot mix asphalt at asphalt plants with multiple silos. In the past there have been several occasions where hot mix asphalt was accidentally discharged incorrectly as a result of a misalignment of the receiving truck. The method and apparatus of the present invention includes the installation of a closed circuit video camera and a system of flashing lights. The video camera has a fixed view of the loading area and provides this view to a monitor at the control panel in the control house. When the plant operator wants to discharge hot-mix asphalt into a truck, a switch, which may be merely entering the data on a computer, is activated. This causes a light beneath the bin to flash is activated, which identifies the bin that has been selected. The operator then views the video monitor displaying the asphalt silos and the truck positioned to receive a load. The operator is now able to visually confirm the position of the truck with respect to the flashing light on the bin that has been activated. The plant operator must push a second button at this time in order to complete the discharge of the hot mix asphalt from the bin. Preferably, the second button is located on a button box either on the monitor or as close to it as possible in order to force the operator to view the screen before activating the second switch.

FIG. 1 illustrates a side view of a control tower 12 located at the exit end of a series of silos 14A–14D. A transceiver 16 is located on a four by four pole and closed circuit camera 17 is mounted on front pillar 18 at the entrance to silos 14A–14D. Also located on a front pillar 18 is a pair of lights, with a red light 20 and a green light 22. Under each of silos 14A–14D is located a hatch 24A–24D, respectively. Each silo 14A–14D is identified by a sign with a flashing light 34A–34D, respectively. Lights 34A through 34D are positioned to be in line with the front of each silo 14A–14D, respectively. Lights 34A, 34B, 34C and 34D alternate between red and yellow so that the silo of operation is more easily identified.

Located near each hatch 24A–24D is an additional light 44A–44D, respectively. Lights 44A through 44D are preferably color coded and are the same color as corresponding lights 34A through 34D. corresponding lights for each silo 14A through 14D are wired together so that when a silo is going to be unloaded both lights corresponding to that silo are illuminated.

Figure 3:
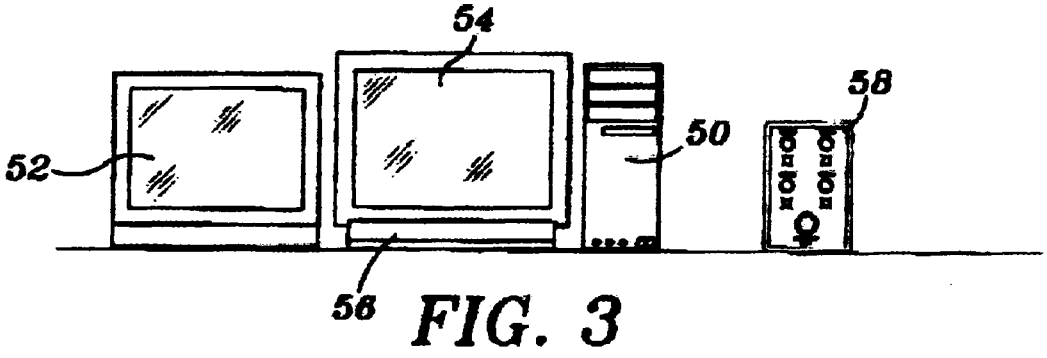
FIG. 3 is a view of the controls in the control house depicted in FIG. 2.

Located several feet from one side of series of silos 12 is a closed circuit television camera 48 which feeds a television monitor 50 located at the loading operators station or control house (see FIG. 3). Television camera 48 is positioned such that it provides a full side view of silos 14A through 14D and their associated lights 34A through 34D. Thus, the silo operator has a full side view of the positioning of the truck with respect to each hatch 24A through 24D and each silo 14A through 14D.

The connections between the control house and the silo area may be of any type currently in use in the art, such as hardwired or through the use of transceiver or the like, however, hardwired is preferred.

Figure 2:
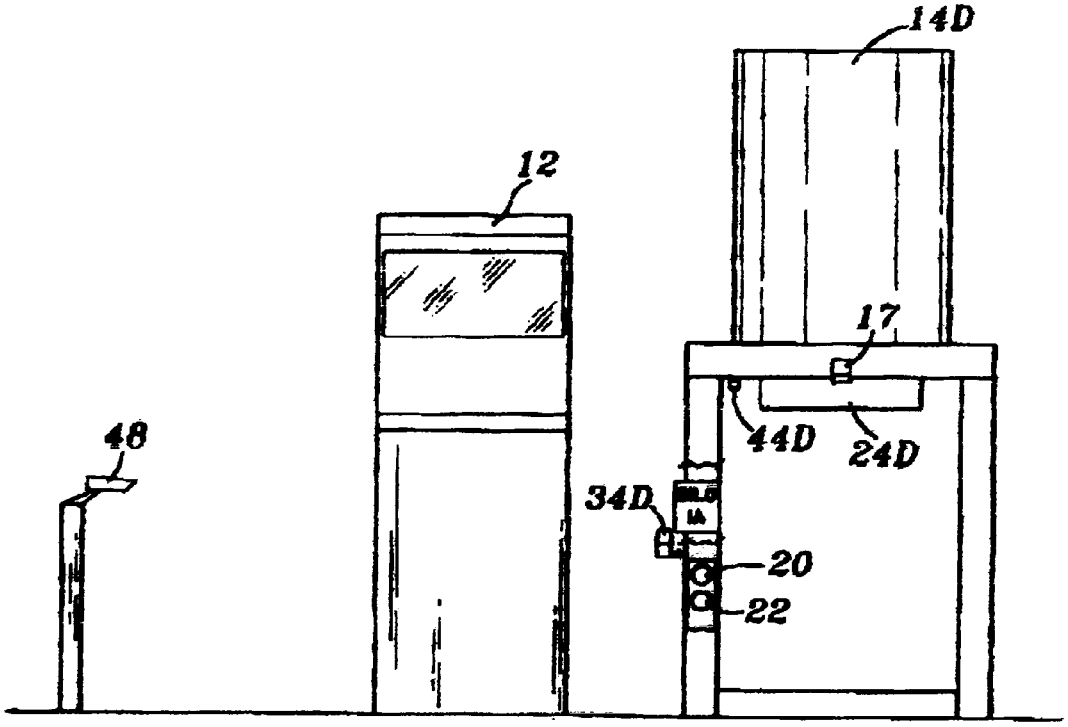
FIG. 2 is an entrance view of the asphalt loading area having a series of asphalt silos at a typical asphalt processing plant.

Referring now to FIG. 2, a front view of a series of silos 14A–14D is illustrated. In this view, red light 20 and green light 22 can be seen. Also in third view, it can be seen that an operator in control tower 12 cannot accurately determine the location of a truck with respect to the position of each silo 14A–14D.

Figure 4:
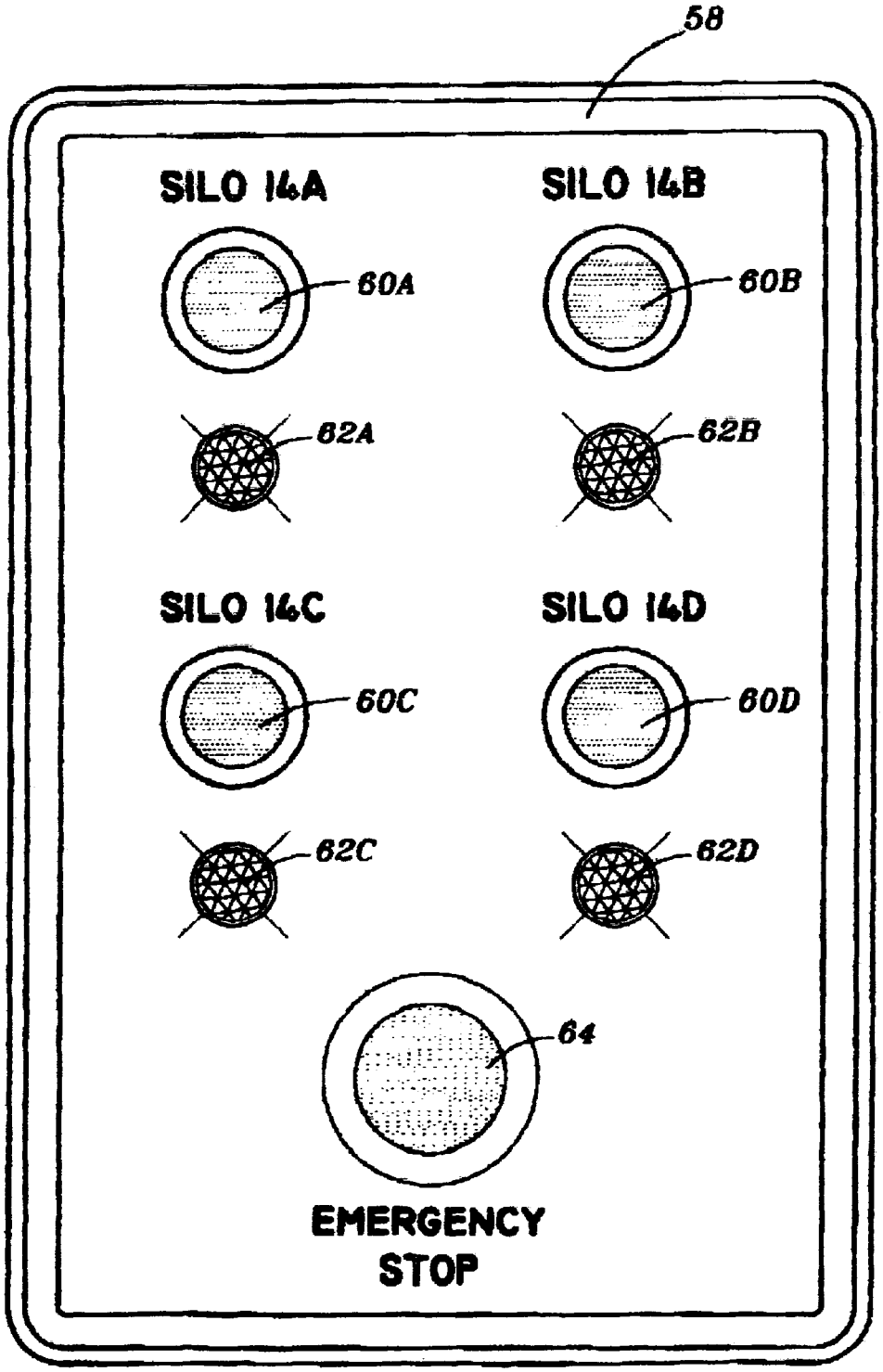
FIG. 4 is an illustration the face of the button box of FIG. 3 located in the control house depicted in FIG. 2.

FIG. 3 illustrates equipment located in control tower 12. Computer 50, monitors 52 and 54 and keyboard 56 are illustrated along with button box 58 (see FIG. 4). Monitor 52 receives its display from closed circuit camera 17. Monitor 54 receives its display from camera 48. Button box 58 as illustrated in FIG. 4 preferably includes one button 60A–60D corresponding to each silo 14A–14D. Each button 60A–60D has an indicating light associated with it, lights 62A–62D, respectively. Button box 58 also includes emergency stop button 64. Emergency stop button 64 is provided to permit stoppage of the entire loading process at any time to assure safety.

Figure 5:
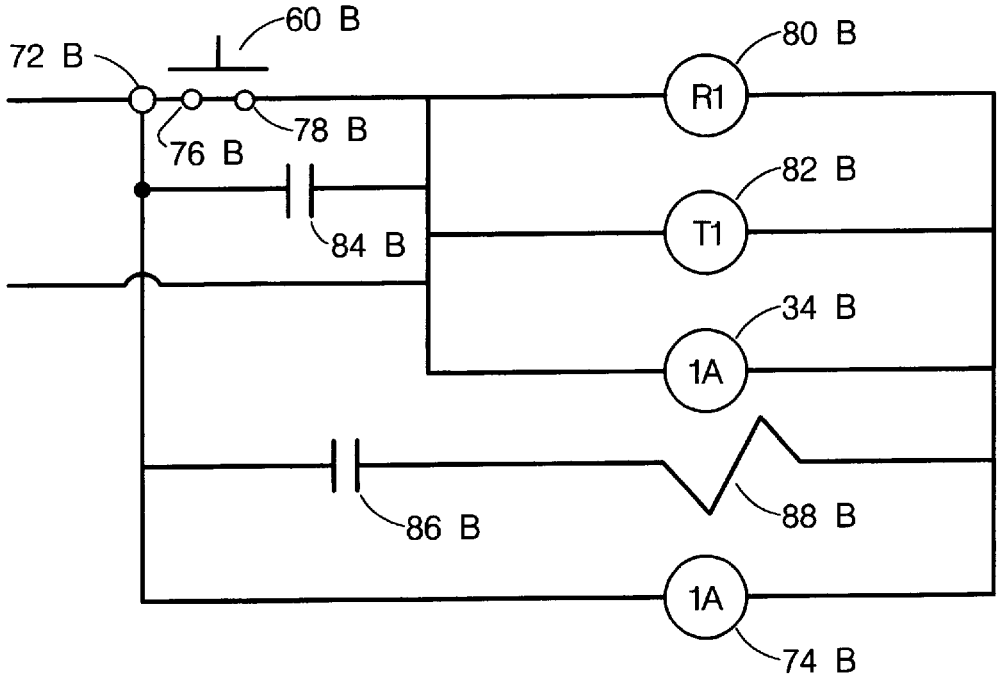
FIG. 5 is a single line diagram of the control circuit for the controls of FIG. 3.

FIG. 5 illustrates the control circuit associated with the controls depicted in conjunction with FIG. 3. Initially, the proper silo must be selected on computer 50, for example silo 14B. A power control circuit 70B for silo 14B operates under the control of computer 50. Each silo will have a similar control circuit, however, for simplification only one will be described.

Power control circuit 70B is electronically interlocked with similar control circuits for additional silo hatch controls by computer 50 to prevent possible energization of more than one silo hatch. When silo 14B is selected, as previously described, circuit 70B energizes node 72B. A light 74B may be associated with the computer selection to aid the operator in indicating the silo line which is energized.

To operate, for example, silo 14B, an operator depresses button 60B on button box 58, which is the second selection that is made or the second button that is depressed to initiate operation of the silo hatch. This closes contacts 76B and 78B which energizes relay 80B and, if required, time delay relay 82B. Relay 80B locks contacts 84B closed so that button 60B need not be held down until time delay relay 82B times out. Relay 80B also energizes light 34B, as previously described. When time delay relay 82B times out, contact 86B closes to energize solenoid 88B, which opens silo hatch 24B.

In operation a truck will pull up to series of silos 14A–14D and speak into transceiver 16. This will activate monitor 52 so that the control tower operator can identify the driver and view any order papers of the driver. The operator then enters the information into computer 50 through keyboard 56 selecting a silo, for example, silo 14B, which will cause 44B to illuminate. Upon confirmation of the order, the driver waits for illuminated red light 20 to be turned off and for green light 22 to become illuminated. At that time the truck driver will pull the truck and position it beneath the designated silo, silo 14B. When the operator is ready to unload the designated silo he will initiate the unloading action by depressing button 60B on button box 58, which will have light 62B illuminated, to open hatch 24B of silo 14B. At this time the corresponding light 34B will flash indicating to the driver and to the operator which silo hatch is about to open. By viewing monitor 54 the operator is able to determine whether the truck is correctly positioned to receive the asphalt. The driver is able to observe the flashing lights 44A–44D located by each hatch 24A–24D to determine whether he is correctly positioned.

In a first embodiment of the present invention the operator must then depress a second button prior to the hatch opening. This provides a fail safe method which requires a positive action by the operator to prevent an error in unloading the asphalt.

In a second embodiment a time delay occurs between depressing the button to unload the hatch and the actual movement of the hatch to unload the asphalt. In the second embodiment an emergency stop button 64 is provided to permit stopping the loading operation in the event that the truck is not in line with the hatch about to open.

Although there is significant danger in loading hot asphalt onto a dump truck, the present invention ameliorates this danger by providing two methods and apparatus for preventing accidental injury. A first embodiment requires a positive action to complete the loading process while a second embodiment requires a positive action to prevent loading hot asphalt.

The present invention provides an asphalt loading safety system for use with a plurality of asphalt silos. This system includes a visual display for identifying which of the asphalt storage silos is to be unloaded, a camera for providing a view of the silos and their associated lights, a switch associated with the visual display for initiating unloading of one of the silos. Further safety checks are included in a security device for controlling unloading of the identified silo. The security device may include a second switch to open the unloading hatch corresponding to the identified silo when visual confirmation is made. The security device may also include a delay device connected to the switch for postponing the opening of a hatch corresponding to the identified silo and a second switch operating in conjunction with the loading process for stopping the entire loading operation. The additional safety features are made possible by the ability to confirm visually whether the truck is correctly positioned.

While there has been illustrated and described a particular embodiment of the present invention, it will be appreciated that numerous changes and modifications will occur to those skilled in the art, and it is intended in the appended claims to cover all those changes and modifications which fall within the true spirit and scope of the present invention.

What is claimed is:

1. An asphalt loading safety control system for use with a plurality of asphalt silos comprising:

plurality of light devices, each light device associated with one of said plurality of asphalt silos;

visual means for identifying which of said plurality of asphalt silos is to be unloaded;

a camera for providing a view of said plurality of asphalt silos and their associated lights;

switch means associated with said visual means for initiating unloading of one of the silos; and security means for assuring correct continued unloading of said identified asphalt silo including delay means connected to a second switch means to open a hatch corresponding to the identified silo, said delay means for postponing opening of said hatch corresponding to the identified asphalt silo.

2. The asphalt loading safety control system according to claim 1 wherein said delay means includes a delay relay connected in series with a solenoid for opening said hatch.

3. The asphalt loading safety control system according to claim 1 also including:

a relay activated by said second switch means for holding the circuit energized.

4. An electric control circuit for use in a system to prevent accidental discharge of hot-mix asphalt at asphalt plants with multiple silos comprising:

a manual switch;

a time delay device activated by said manual switch to provide a time period to determine whether the discharge should continue; and a solenoid connected to said manual switch through said time delay relay to open a hatch on a hot mix storage silo when said time period elapses.

5. The electric control circuit according to claim 4 wherein said time delay device includes a time delay relay connected in series with said solenoid to provide a time lag before said hatch opens.

6. The circuit according to claim 4 also including:

a relay activated by said manual switch for holding the circuit energized.

7. A method for controlling discharge of hot-mix asphalt at asphalt plants with multiple silos comprising:

initiating discharge of said hot-mix asphalt;

providing a time delay after initiating said discharge by a time delay relay to provide a time period to determine whether the discharge should continue;

opening a hot mix storage silo when said time period elapses.

8. The method according to claim 7 wherein said initiating includes providing a locking relay to keep said time delay relay energized during said period.

* * * * *